United States Patent [19]

Zeitel

[11] Patent Number: 4,466,536

[45] Date of Patent: Aug. 21, 1984

[54] PATTERN FOR A BOX FOR CIGARETTES OR CIGARILLOS

[75] Inventor: Joachim Zeitel, Hagen, Fed. Rep. of Germany

[73] Assignee: Maschinenfabrik Alfred Schmermund GmbH & Co., Gevelsberg, Fed. Rep. of Germany

[21] Appl. No.: 451,977

[22] Filed: Dec. 21, 1982

[30] Foreign Application Priority Data

Dec. 21, 1981 [DE] Fed. Rep. of Germany ..... 3150561

[51] Int. Cl.[3] ..... B65D 85/10; B65D 5/66; B65B 11/48

[52] U.S. Cl. ..... 206/273; 206/268; 229/44 CB

[58] Field of Search ..... 206/273, 271, 259, 268; 229/44 CB

[56] References Cited

U.S. PATENT DOCUMENTS 4,251,022 2/1981 Focke ..... 229/44 CB
4,392,338 7/1983 Fox ..... 206/268

FOREIGN PATENT DOCUMENTS 2362427 6/1975 Fed. Rep. of Germany ... 229/44 CB
1431173 4/1976 United Kingdom ..... 229/44 CB
1582329 1/1981 United Kingdom ..... 229/44 CB
2054524 2/1981 United Kingdom ..... 229/44 CB

*Primary Examiner*—William T. Dixson, Jr.
*Assistant Examiner*—Brenda J. Ehrhardt

[57] ABSTRACT

A pattern for a box which may receive a produce such as cigarettes will, when folded, define a box neck inwardly offset relative to the sides of the box, the neck being positioned within a lid when the box is closed. The box neck is formed by a front section, connected to the front wall of the box by an embossed edge, and a pair of oppositely disposed side sections which are partly connected to the side walls of the box adjacent to the front wall, this partial connection being achieved by centrally disposed embossed regions and cuts extending in either direction therefrom. The cuts which extend inwardly from the embossed edge regions terminate at punched-out areas located at either end of the embossed edge between the box neck front section and the box front wall. These punched-out areas have a width which corresponds minimally to the thickness of the material in which the pattern is rendered. Cuts extend from these punched-out areas and are shaped so as to define ears on the longitudinal sides of the neck in the completed box.

12 Claims, 13 Drawing Figures

PATTERN FOR A BOX FOR CIGARETTES OR CIGARILLOS

BACKGROUND OF THE INVENTION (1) Field of the Invention

This invention relates to packaging and particularly to the formation of packages from stiff paper, cardboard or the like. More particularly, the present invention is directed to a box pattern or blank and especially a pattern for a "hard" package for cigarettes, cigarillos or the like. Accordingly, the general objects of the present invention are to provide novel and improved methods and articles of such character.

(2) Brief Description of the Prior Art

While not limited thereto in its utility, the present invention is particularly well-suited for use in the packaging of cigarettes or cigarillos. "Hard" packages for such products are well-known in the art. A pattern from which such a "hard" package may be formed is shown in British Pat. No. 1,431,173. In the pattern or blank of this British Patent the box neck is defined by a front section and two side section which, when the box is formed, are set back in relation to the remainder of the box by the thickness of the cardboard which comprises the blank. The front section of the neck is connected to the front wall of the box, in the unfolded pattern, by an embossed edge. Cuts, which extend around the offset of the box neck, are provided between the side sections of the neck and the adjacent side walls of the box. These cuts extend into the area of the embossed edge. Fold lines extend from the inwardly disposed ends of these cuts between the front section and the side sections of the neck, the fold lines being parallel to the longitudinal sides of the pattern and being interrupted by cuts which form ears. In order to make a "perfect" box, i.e., a box which has parallel sides and is free from distortions, it is necessary to provide another punching in the area of the inner side walls which is connected to the rear wall and to glue the side sections to the areas of the inner side walls which are exposed by these punchings. This is an expensive procedure.

Another technique for the fabrication of a "hard" package similar to the package of the above-discussed British Patent may be seen from German Pat. No. 23 62 427. In the technique of this German Patent T-shaped cuts are provided at the corners between the front side and the neck of the box. However, since the material is obstructed, this does not produce satisfactory results and, in fact, precludes the formation of a "perfect" box. Further, the technique of this German Patent also shares the deficiency that the neck of the box projects toward its free end.

SUMMARY OF THE INVENTION

The present invention overcomes the above-briefly discussed and other deficiencies of the prior art and, in so doing, permits the fabrication of a "perfect" package with minimum expense. In accordance with the invention, a box pattern includes a central section which, when folded, defines the receiving space of the box. The pattern also includes two end sections which are respectively formed into a box neck, which is offset in relation to the side walls of the receiving space of the box, and a lid coupled to the rear wall of the box, the lid covering the neck when the completed box is closed. The end section which is formed into the box neck comprises a front section and two oppositely disposed side sections which are connected to the front section and are folded relative thereto along parallel fold lines. These fold lines are displaced inwardly a distance determined by the offset of the box neck relative to fold lines which are provided between the front wall and side walls of the receiving space defining central section of the pattern. The fold lines between the neck defining section front and side sections are also interrupted by cuts which define ears. The side sections of the neck defining section are separated from the adjacent box receiving space defining side walls by cuts. The front section of the neck defining section is connected to the front wall of the receiving space defining section by an embossed edge. A unique characteristic of the present invention resides in the fact that cuts are provided along the fold lines between the side sections of the neck defining section and the adjacent receiving space defining side walls, these cuts being interrupted by embossed regions in the central areas of the fold lines, the embossed regions thus connecting the side sections of the neck forming section to the adjacent side walls of the receiving space. A box pattern in accordance with the present invention is further defined by a punching at each end of the embossed edge between the front section of the neck forming section and the adjacent front wall of the receiving space, the inwardly disposed cuts along the fold lines between the neck forming section side sections and the receiving space side walls terminating at these punchings. These punchings are slightly wider than the thickness of the material in which the pattern is rendered.

Employing the pattern briefly described, a box may be fabricated with minimal gluing and particularly without gluing after the box has been folded. Additionally, stamping operations are minimized.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which.

DESCRIPTION OF THE PREFERRED EMBODIMENT

Figure 1:
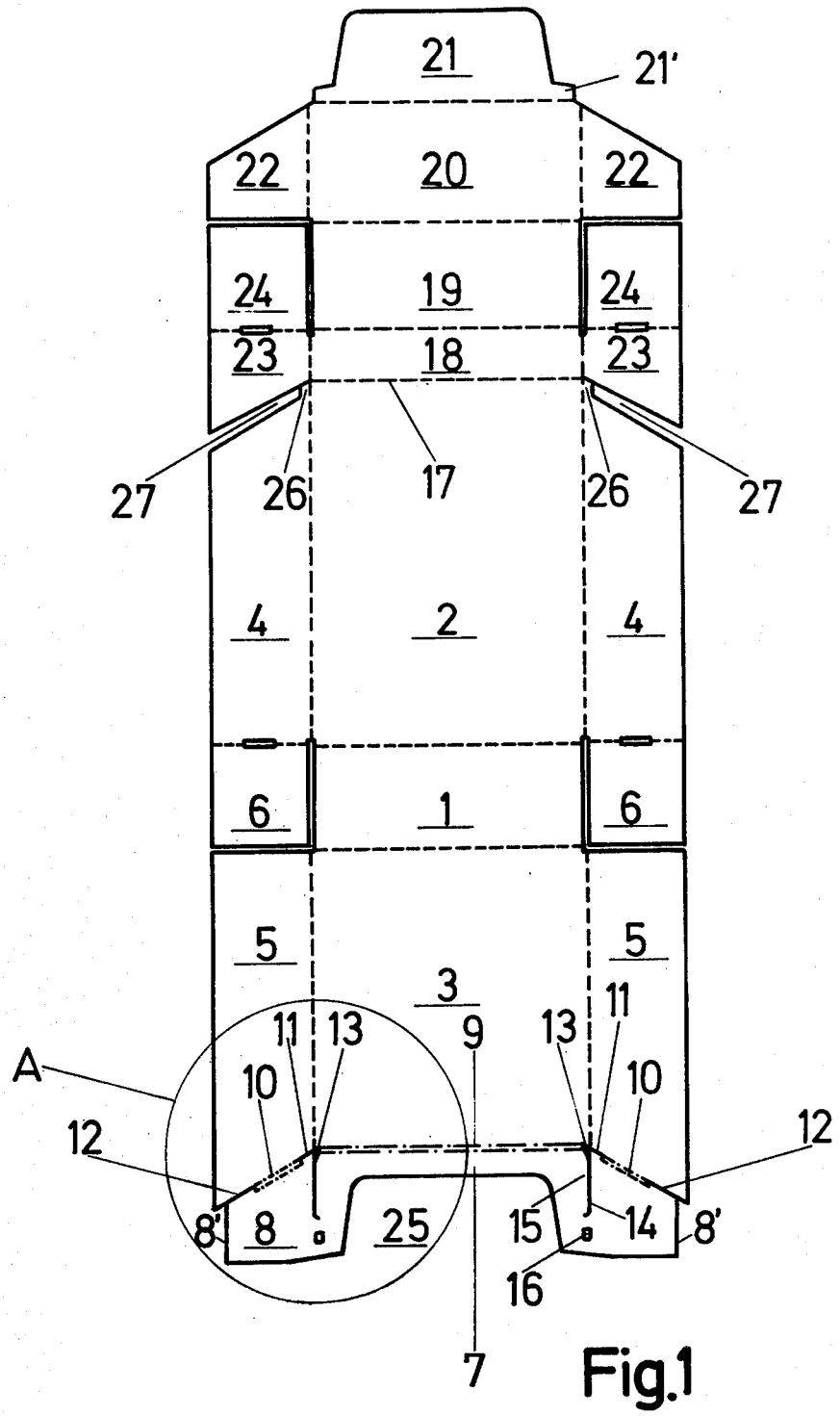
FIG. 1 depicts a pattern for a box for cigarettes or cigarillos in accordance with the invention.
Figure 2:
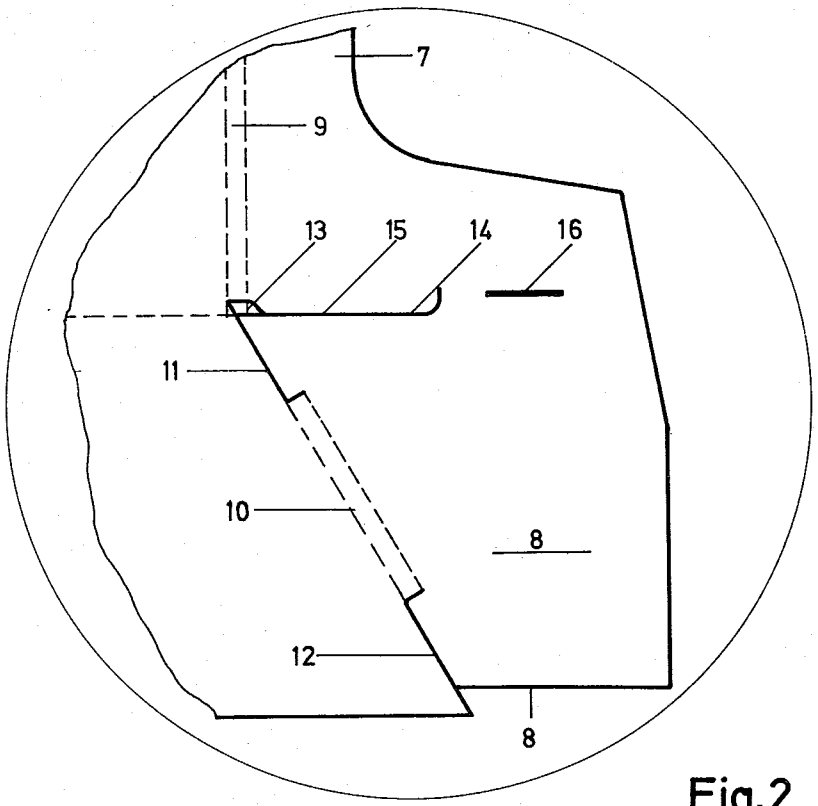
FIG. 2 is an enlarged view of detail A of FIG. 1.

With reference now to the drawing, considering all three FIGURES simultaneously, a pattern from which a box is to be formed is defined in a sheet of stiff paper or cardboard by means of cutting and embossing operations. In FIGS. 1 and 2 lines along which the sheet material has been cut are represented by solid lines and in FIG. 1 fold lines are indicated by a series of dashes whereas embossed regions are represented by parallel broken lines, i.e., dotted and dashed lines. The pattern represented in FIG. 1 includes a rectangular base 1 which is connected by fold lines to a rear wall 2 and a front wall 2. Side walls 4 are defined by a pair of oppositely disposed longitudinal side portions of rear wall 2. Similarly, side walls 5 are defined by a pair of oppositely disposed longitudinal side portions 5 of front wall 3. The side walls 4 and 5 will overlap to form double thickness receiving space defining side walls when the pattern is folded and glued. The side walls 4 support, adjacent to base 1, base tabs 6. In the completed box the tabs 6 are attached to the inside of base 1. In the exemplary embodiment shown, the base tabs 6 are joined to side walls 4 by a combined cut and fold line and are separated from base 1 and side walls 5 by slots.

A box neck is formed from a neck defining section of the pattern having a front section 7 and a pair of oppositely disposed side sections 8. The front section 7 is connected to the adjacent front wall 3 by an embossed edge 9 which is preferably formed as a double embossing. The side sections 8 are connected to the adjacent side walls 5 by embossed edges or regions 10. The embossed regions 10 do not extend the entire length of the line of separation between the side walls 5 and side sections 8 but, rather, are provided only in the central region as shown. The remainder of the dividing line between the side sections 8 and side edges 5 is defined by cuts 11 and 12. The cuts 12 extend inwardly from the outer edges 8' of side sections 8. The cuts 11 extend from the end of the embossed regions 10 to stampings, i.e., punched-out areas, 13. As best seen from FIG. 2, the stampings 13 have a width, perpendicular to the longitudinal axis of the pattern, which is slightly greater than the thickness of the sheet material in which the pattern is formed. The stampings 13 are effectively extensions of the fold line between front wall 3 and its adjacent side walls 5 and begin at embossed edge 9. Cuts 14 extend from stampings 13. The cuts 14, in the completed package, define ears 15 which serve to hold a lid. Thus, the cuts 14 are parallel to and above part of the fold lines between front section 7 and side sections 8. Because of the offset of the box neck resulting from the double embossed edge 9, these fold lines are displaced inwardly from and are parallel to the fold lines between the front wall 3 and its adjacent attached side walls 5. The cuts 14 are directed inwardly at their ends to form the ears 15, the outer edges of the ears defining an extension of the fold lines between front wall 3 and side walls 5. This relationship may best be seen by a comparison of FIGS. 2 and 3.

In order to facilitate the formation of a well-defined fold when the pattern of FIG. 1 is ultimately folded into the box configuration, the fold lines between front section 7 and side sections 8 of the neck defining portion of the pattern may be provided with cuts or punched-out areas 16.

The embossed edges 9 and 10 result, in the finished box, in an offset of the box neck relative to the receiving portion of the box and the lid. The stampings 13 prevent the side sections 8 from interferring with front section 7 at the corners between the receiving section front wall 3 and the neck. Any such interference would preclude the production of a box having a "perfect" appearance.

The outer edges 8' of side sections 8 are displaced inwardly relative to the longitudinal sides of the remainder of the pattern, particularly the parallel outer edges of the side wall defining portions 4 and 5, by a distance which is at least as great as the offset of the box neck.

The lid defining section of the pattern is coupled to the rear wall 2 by a fold line 17 and comprises a rear lid wall 18, a lid base 19, a front lid wall 20 and a reinforcement 21 for wall 20. All of wall 18, base 19, wall 20 and reinforcement 21 are separated from the adjacent member or members by a fold line and these fold lines are parallel. Side lid walls 22 are provided at both sides of front lid wall 20 and are separated from the front lid wall by fold lines. Side tabs 23 are provided on both sides of rear lid wall 18 and are separated from the latter by means of fold lines. Reinforcement tabs 24 are connected to side tabs 23 by combined fold and cut lines as shown, the reinforcement tabs 24 being separated from side lid walls 22 and lid base 19 by cuts. In the formation of the box the reinforcement tabs 24 are glued to lid base 19 and side tabs 23 are glued to side walls 22 on the interior of the box.

The reinforcement 21 is essentially complementary in shape to a notch 25 which is formed in the face of the front section 7 of the neck defining section. This is done to minimize waste. Reinforcement 21 possesses, adjacent to the fold line by which it is joined to front lid wall 20, a base section 21' which extends the entire length of the fold line. The side edges of base section 21' are parallel to the longitudinal sides of the pattern to facilitate clean folding.

The receiving space defining side walls 4 and 5, and thus also side sections 8 of the neck defining section, are trapezoidal in shape. The side lid walls 22 and side tabs 23 have shapes that are complementarily trapezoidal.

Cuts 26 and punchout slots 27, the slots defining extensions of the cuts, are provided between the adjacent diagonal edges of side tabs 23 and side walls 4. The material remaining between the inwardly disposed ends of slots 27 and the fold lines between rear wall 2 and side walls 4 insures perfect folding. The width of the slots 27 is selected such that no overlapping occurs at side sections 8 in the area where the box neck is offset. The inward offset of the outer edges of 8' of side sections 8 is also selected such that no overlapping occurs with the remaining section of side wall 4 adjacent to cut 26.

Figure 3:
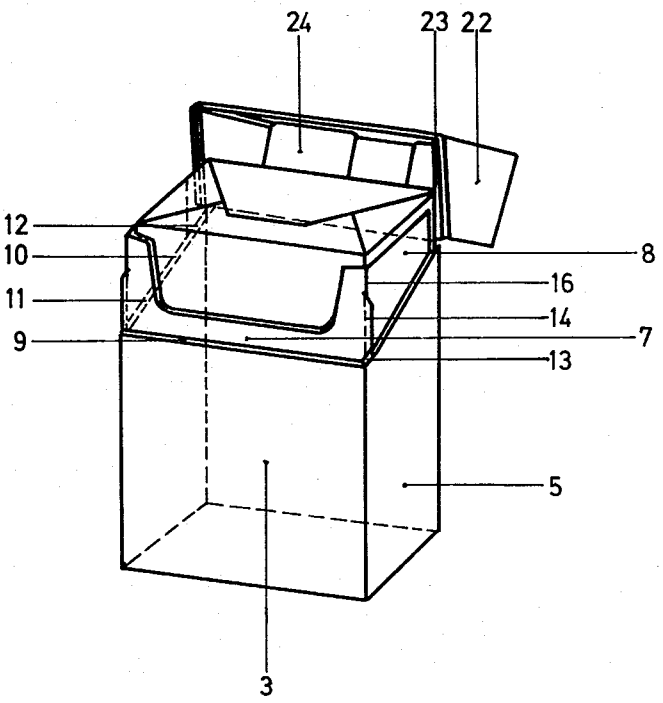
FIG. 3 is a perspective view of a box produced from the pattern of FIG. 1.

In a completed box formed from the pattern of FIG. 1, as may be seen from FIG. 3, the lid folds backwardly about the fold line 17. The pattern of the present invention eliminates the necessity of extending cuts diagonally into the rear wall 2, i.e., extensions of cuts 26, to facilitate opening of the box.

In the fabrication of the pattern of FIG. 1 the embossed regions 9 and 10 may be formed in a single step. When the box is ultimately formed the gluing of the side sections 8 is not necessary.

While a preferred embodiment has been shown and described, it is to be understood that the invention is not limited to the illustration described and shown herein, which is deemed to be merely illustrative of the best mode of carrying out the invention, and which is susceptible to modifiction as to form, size, arrangement of parts and details of operation. The invention rather is intended to encompass all such modifications which are within its spirit and scope as defined by the claims.

What is claimed is:

1. In a pattern for a box, the pattern being provided with a central section for defining a receiving space in the box and a pair of end sections which respectively will form the neck of the box and a lid coupled to the rear wall of the box, the box neck forming end section including a front defining section and two oppositely disposed side defining sections connected thereto, the side sections being foldable with respect to the front section along fold lines, the central section including a front wall defining section and a pair of side wall defining sections which will be folded with respect thereto along fold lines, the fold lines between the front and side sections of the neck forming end section being displaced inwardly relative to the fold lines between the front wall and its associated side walls of the central section whereby the box neck will be offset relative to the outside wall of the receiving space, the fold lines between the front and side sections of the neck forming section be interrupted by cuts which form ears, the side sections of the neck forming section being partially separated from adjacent side walls of the central section by cuts and the front section of the neck forming section being coupled to the front wall of the central section by an embossed edge, the improvement comprising: the junction between the side sections of the neck forming section and the adjacent side walls of the central section being in the form of centrally disposed embossed regions with slots extending in both directions therefrom to the opposite edges of the neck forming section side sections, a punched-out region at each end of the embossed edge between the front section of the neck forming section and the central section, the width of the punched-out regions being greater than the thickness of the material in which the pattern is formed, the inwardly disposed pair of said cuts between the side sections and side walls terminating at respective of the punched-out regions.

2. The pattern of claim 1 further comprising slits which extend from said punched-out regions, said slits effectively comprising extensions of the fold lines between the front and side walls of the central section, said slits being shaped so as to define said ears when said pattern is folded into a box.

3. The pattern of claim 1 wherein said central section includes a second pair of side walls connected to a rear wall and wherein said improvement further comprises a pair of oppositely disposed slots extending inwardly from the outer edge of the pattern at the junction between the central section and the lid defining end section, the edges of said slots being positioned beneath the offset of the box neck in the finished box.

4. The pattern of claim 2 wherein said central section includes a second pair of side walls connected to a rear wall and wherein said improvement further comprises a pair of oppositely disposed slots extending inwardly from the outer edge of the pattern at the junctions between the central section and the lid defining end section, the edges of said slots being positioned beneath the offset of the box neck in the finished box.

5. The pattern of claim 3 wherein said slots lie between the second pair of side walls and the lid defining end section and terminate outwardly with respect to the lines about which the side walls are folded relative to the rear wall, said slots being extended by slits whereby a section of the side walls remain adjacent to the fold line with the rear wall, said pattern further comprising the outer edges of the side sections of the neck defining section being displaced inwardly by a distance which corresponds to the width of said slots, said inwardly displaced side edges of said side sections being parallel to the side edges of said side walls.

6. The pattern of claim 4 wherein said slots lie between the second pair of side walls and the lid defining end section terminate outwardly with respect to the lines about which the side walls are folded relative to the rear wall said slots being extended by slits whereby a section of the side walls remain adjacent to the fold line with the rear wall, said pattern further comprising the outer edges of the side sections of the neck defining section being displaced inwardly by a distance which corresponds to the width of said slots, said inwardly displaced side edges of said side sections being parallel to the side edges of said side walls.

7. The pattern of claim 1 wherein said lid forming end section includes a rear lid wall, a lid base and a front lid wall, said lid walls being connected to said lid base by fold lines, and wherein said improvement further comprises a lid reinforcement coupled to the lid front wall by a fold line, said lid reinforcement having a base section with a width commensurate with the width of the lid front wall and a second section of reduced width.

8. The pattern of claim 2 wherein said lid forming end section includes a rear lid wall, a lid base and a front lid wall, said lid walls being connected to said lid base by fold lines, and wherein said improvement further comprises a lid reinforcement coupled to the lid front wall by a fold line, said lid reinforcement having a base section with a width commensurate with the width of the lid front wall and a second section of reduced width.

9. The pattern of claim 3 wherein said lid forming end section includes a rear lid wall, a lid base and a front lid wall, said lid walls being connected to said lid base by fold lines, and wherein said improvement further comprises a lid reinforcement coupled to the lid front wall by a fold line, said lid reinforcement having a base section with a width commensurate with the width of the lid front wall and a second section of reduced width.

10. The pattern of claim 4 wherein said lid forming end section includes a rear lid wall, a lid base and a front lid wall, said lid walls being connected to said lid base by fold lines, and wherein said improvement further comprises a lid reinforcement coupled to the lid front wall by a fold line, said lid reinforcement having a base section with a width commensurate with the width of the lid wall and a second section of reduced width.

11. The pattern of claim 5 wherein said lid forming end section includes a rear lid wall, a lid base and a front lid wall, said lid walls being connected to said lid base by fold lines, and wherein said improvement further comprises a lid reinforcement coupled to the lid front wall by a fold line, said lid reinforcement having a base section with a width commensurate with the width of the lid wall and a second section of reduced width.

12. The pattern of claim 6 wherein said lid forming end section includes a rear lid wall, a lid base and a front lid wall, said lid walls being connected to said lid base by fold lines, and wherein said improvement further comprises a lid reinforcement coupled to the lid front wall by a fold line, said lid reinforcement having a base section with a width commensurate with the width of the lid front wall and a second section of reduced width.

* * * * *